US011753192B2

(12) United States Patent
Parviainen et al.

(10) Patent No.: US 11,753,192 B2
(45) **Date of Patent: *Sep. 12, 2023**

(54) FILLING DEVICE FOR FILLING AN AEROSOL CONTAINER WITH A LIQUID

(71) Applicant: Wisespray International Oy, Veikkola (FI)

(72) Inventors: Ilkka Parviainen, Helsinki (FI); Marcus Weckman, Vantaa (FI)

(73) Assignee: Wisespray International Oy, Veikkola (FI)

( * ) Notice: Subject to any disclaimer, the term of this patent is extended or adjusted under 35 U.S.C. 154(b) by 0 days.

This patent is subject to a terminal disclaimer.

(21) Appl. No.: 17/972,058

(22) Filed: Oct. 24, 2022

(65) Prior Publication Data

US 2023/0044075 A1 Feb. 9, 2023

Related U.S. Application Data

(63) Continuation of application No. 17/290,101, filed as application No. PCT/EP2019/077338 on Oct. 9, 2019, now Pat. No. 11,485,524.

(30) Foreign Application Priority Data

Oct. 31, 2018 (EP) ..... 18203769

(51) Int. Cl.
*B65B 3/12* (2006.01)
*B65B 31/00* (2006.01)

(52) U.S. Cl.
CPC ..... *B65B 3/12* (2013.01); *B65B 31/003* (2013.01)

(58) Field of Classification Search
CPC ..... B65B 3/12; B65B 31/003
See application file for complete search history.

(56) References Cited

U.S. PATENT DOCUMENTS 3,335,765 A 8/1967 Moonan
3,444,906 A 5/1969 Moonan et al.
(Continued)

FOREIGN PATENT DOCUMENTS

CA 2638576 A1 2/2009
CN 101287651 A 8/2006
(Continued)

OTHER PUBLICATIONS

Search Report in the connection to Chinese Patent Application No. 2019800712539, dated Jun. 6, 2022.
(Continued)

*Primary Examiner* — Timothy L Maust
(74) *Attorney, Agent, or Firm* — Meunier Carlin & Curfman LLC

(57) ABSTRACT

Filling device for filling an aerosol container with a liquid, such as paint, which device comprises a cup for the liquid for the aerosol container, which cup is provided with an injection opening at its bottom surface; a piston for pushing the liquid from the cup via the injection opening to the aerosol container; and a piston head that is adapted to be detachably fixed on the end of the piston to be in contact with the liquid in the cup when the liquid is transferred from the cup to the aerosol container, which piston head is in the form of a scraper in continuous contact with the side wall of the cup during the liquid transferring operation, wherein the detachable fixing of the piston head allows the piston head to be withdrawn together with the piston from the cup after the liquid transferring operation is done.

10 Claims, 2 Drawing Sheets

(56) References Cited

U.S. PATENT DOCUMENTS

| | | | |
|---|---|---|---|
| 3,797,534 | A | 3/1974 | Skidmore |
| 5,377,724 | A | 1/1995 | Ray |
| 5,535,790 | A | 7/1996 | Hirz |
| 5,740,841 | A | 4/1998 | Hirz |
| 5,832,965 | A | 11/1998 | Fasse et al. |
| 6,138,720 | A | 10/2000 | Zeigler |
| 7,909,070 | B2 | 3/2011 | Chassaing |
| 8,141,597 | B2 | 3/2012 | Chassaing |
| 11,485,524 | B2 * | 11/2022 | Parviainen ..... B65B 3/12 |
| 2006/0042717 | A1 | 3/2006 | Faure |
| 2007/0062604 | A1 | 3/2007 | Chassaing |
| 2009/0038708 | A1 | 2/2009 | Hirz |
| 2009/0078333 | A1 | 3/2009 | Chassaing |

FOREIGN PATENT DOCUMENTS

| | | | |
|---|---|---|---|
| CN | 103339030 | A | 10/2013 |
| CN | 107810143 | A | 3/2018 |
| DE | 1303782 | B | 7/1975 |
| DE | 202006020389 | U1 | 6/2008 |
| DE | 102007057209 | A1 | 5/2009 |
| EP | 0440477 | A1 | 8/1991 |
| EP | 1943146 | B1 | 12/2009 |
| EP | 2039606 | B1 | 3/2010 |
| WO | 2009063253 | A2 | 2/2009 |
| WO | 2012078211 | A1 | 6/2012 |
| WO | 2016205023 | A1 | 12/2016 |

OTHER PUBLICATIONS

Notice of Opposition in the corresponding European Patent No. 3647210, dated Mar. 11, 2022.

International Search Report and Written Opinion for International Application No. PCT/EP2019/077338 dated Nov. 25, 2019.

European Search Report for EP Application No. 18203769.7 dated Feb. 25, 2019.

* cited by examiner

FILLING DEVICE FOR FILLING AN AEROSOL CONTAINER WITH A LIQUID

CROSS-REFERENCE TO RELATED APPLICATIONS

This application is a continuation of U.S. application Ser. No. 17/290,101, filed Apr. 29, 2021, which is a national stage application filed under 35 U.S.C. § 371 of international PCT application serial number PCT/EP2019/077338, titled "FILLING DEVICE FOR FILLING AN AEROSOL CONTAINER WITH A LIQUID," filed Oct. 9, 2019, which claims priority to and benefit of European patent application serial number 18203769.7, filed Oct. 31, 2018, the contents of which are incorporated herein by reference in their entirety.

BACKGROUND

The present invention relates to a filling device for filling an aerosol container with a liquid, such as paint.

Different types of devices for filling an aerosol container with a liquid are known from prior art. These known filling devices are typically operated so, that a cup for the liquid to be transferred is first mounted and fixed at the top end of an aerosol container. This is done since the cup comprises a filling opening at its bottom, through which the liquid is transferred into the aerosol container and connecting the cup first to the aerosol container prevents the liquid from leaking through the filling opening once it is dosed into the cup. When the cup is connected to the aerosol container, the filling opening is located against the valve of the aerosol container. Then the liquid to be transferred is dosed into the cup and the entity comprising the cup and the aerosol container is manually inserted inside the filling device. Since the sizes of the aerosol containers vary, the height setting for the bottom surface supporting the bottle and the cup needs to be manually set for each size. Once the aerosol container together with the cup are properly placed inside the filling device, the transfer process is carried out with a vertically movable piston pushing the liquid from the cup via the filling opening of the cup and the valve of the aerosol container to the aerosol container. After the transfer of the liquid is done, the piston is withdrawn from the cup and the filled aerosol container together with the cup is removed from the filling machine.

When the type of liquid is changed, such as a color of paint to be filled in an aerosol container, the parts of the device related for transferring the liquid to an aerosol container typically needs to be cleaned, at least the cup and the piston, which is time consuming and creates problematic waste, for example. Other problems with these known filling devices include: spilling of the liquid in the cup when the aerosol container together with the cup is manually inserted inside the filling device, and incorrect manual support setting for the size of the aerosol container leads to significant cleaning operation for the whole inside of the filling device, for example.

One known solution for overcoming the above mentioned cleaning problem is disclosed in publication EP 1 943 146 B1. In this solution a cup is provided in the filling device for the liquid, such as paint, to be filled in an aerosol container, from which cup the liquid is pressed into the aerosol container by means of a pusher element with a detachable piston head. Once the pressing is done, the piston head is left in the cup, which cup together with the piston head can be then used as a cap for the filled aerosol container. Thus, all of the parts in contact with the liquid are removed from the filling device and either discarded or utilized as a cap, so the need for cleaning of the filling device is eliminated. This solution, however, requires replacement of the cup and the piston head after each filling of a container.

SUMMARY

The present invention provides a filling device which can be used without cleaning action with replaceable parts, which replaceable parts needs to be changed only with changing of the liquid to be filled in the aerosol container. Thus, several aerosol containers can be filled quickly with same liquid without any extra steps relating to cleaning or changing of the required parts of the filling machine.

The filling device of the invention for filling an aerosol container with a liquid, such as paint, comprises a cup for the liquid for the aerosol container, which cup is provided with an injection opening at its bottom surface; a piston for pushing the liquid from the cup via the injection opening to the aerosol container; and a piston head that is adapted to be detachably fixed on the end of the piston to be in contact with the liquid in the cup when the liquid is transferred from the cup to the aerosol container, which piston head is in the form of a scraper in continuous contact with the side wall of the cup during the liquid transferring operation, wherein the detachable fixing of the piston head allows the piston head to be withdrawn together with the piston from the cup after the liquid transferring operation is done.

In an embodiment of the filling device of the invention the detachable fixing of the piston head to the piston is implemented with interlocking forms.

In an embodiment of the filling device of the invention the device comprises means for detaching the piston head from the piston. Advantageously this can be implemented with suitable counter surface, against which the edge of the piston head sets with an additional movement of the piston, and once the piston is moved further, the counter surface forces the piston head to detach from the piston.

In an embodiment of the filling device of the invention the device comprises devices for detecting the attachment of the piston head to the piston. In this embodiment the filling device advantageously also comprises means for preventing the activation or use of the device when the attachment of the piston head to the piston is not detected.

In an embodiment of the filling device of the invention the device comprises a door construction for inserting the aerosol container into the device and removing the aerosol container from the device, which door construction comprises support for the aerosol container.

In the above embodiment, the door construction preferably also comprises support for the cup for the liquid or for a part supporting the cup.

In an embodiment of the filling device of the invention with the door construction the support for the aerosol container in the door construction supports the aerosol container from the lower end area of the container, preferably at least from the bottom surface and/or bottom edges of the aerosol container, and that the support for the aerosol container comprises mechanism for adjusting the vertical position of the support surface. The bottom portion of the aerosol container means in this context the area of the end opposite to the end where the valve of the aerosol container is located. Further, the mechanism for adjusting the vertical position of the support surface of the support for aerosol container preferably utilizes springs for obtaining the adjustability.

In an embodiment of the filling device of the invention the frame and/or the door construction is equipped with suitable support surfaces, which support the cup for liquid or the part supporting the cup for liquid. This way the vertical force created by the downwards movement of the piston is carried by these support surfaces and conveyed to the frame of the filling device, so that this force is not directly conveyed to the aerosol container to be filled. Thus, the mechanism for adjusting the support surface for the lower end area of the aerosol container discussed in the above embodiment needs only bear the significantly smaller force created by the propellant located inside the aerosol container resisting the introduction of the liquid inside the aerosol container during the transferring process. The said supporting surfaces for the part supporting the cup for liquid contact the part supporting the cup via its bottom surface.

In an embodiment of the filling device of the invention with the door construction the door construction is formed as a detachable entity from the rest of the filling device, to which entity the aerosol container and the cup for the liquid is attachable prior to inserting the door construction into the filling device.

In an embodiment of the filling device of the invention with the door construction the support for aerosol container in the door construction comprises at least one magnet. The magnet preferably assists in the fixing of the aerosol container in the door construction and allows for fixing other type of vessels to the door construction.

More precisely the features defining a filling device in accordance with the present invention are presented in claim 1. Dependent claims present advantageous features and embodiments of the invention.

BRIEF DESCRIPTION OF THE DRAWINGS

Exemplifying embodiment of the invention and its advantages are explained in greater detail below in the sense of example and with reference to accompanying drawings, where.

DETAILED DESCRIPTION

Figure 1:
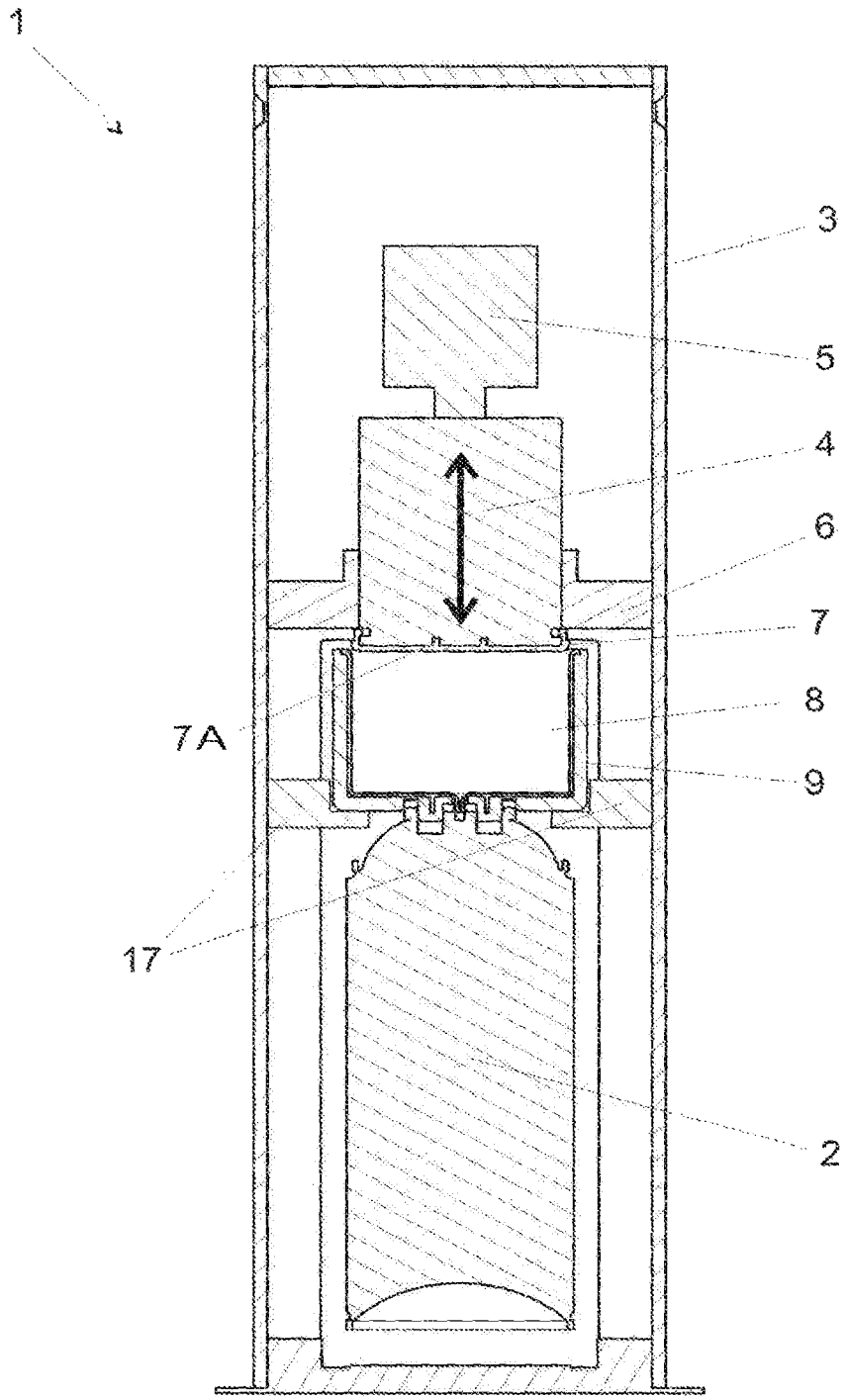
FIG. 1 shows schematically an embodiment of a filling machine of the invention as a sectional view.

FIG. 1 shows schematically as a sectional view a filling device 1 for filling an aerosol container 2 with a liquid. The filling device 1 comprises a frame 3 defining the outer boundary of the device and providing suitable support and fixing surfaces for the other parts of the device, as well as cover and protection for the user during the filling process.

The frame 3 comprises a support section 6 dividing the inside area restricted with the frame into upper and lower portions. The enclosed upper portion of the frame 3 comprises a piston 4, which is typically an axially symmetrical piece in form of a cylinder, and a device 5 for moving the piston in the directions shown with a double head arrow in the figure. The piston 4 extends from the upper portion of the frame 3 through the support section 6 into the lower portion of the frame. The device 5 for moving the piston 4 can be any device suitable for providing linear back-and-forth movement, such as hydraulic or pneumatic drive, but preferably it is an electric motor with a mechanism for converting rotational movement to a linear movement. The enclosed upper part of the frame 3 also includes the required electronics and logic circuits (not shown) for operating the filling device 1. Alternatively, the filling device 1 can be manually operated, where the linear back-and-forth movement of the piston 4 is achieved with a mechanism comprising a lever extending outside of the frame 3, for example, wherein by manually moving the lever the piston is moved inside the filling device during the filling operation of the aerosol container 2.

The lower portion of frame 3 is located below the support section 6 and is equipped with a suitable closeable opening for allowing access inside the lower portion. Inside the lower portion of frame 3, fixed on the end of the piston 4, is a piston head 7. In this embodiment the detachable fixing of the piston head 7 to the piston 4 is implemented via edge protrusions 7A formed in the piston head, which edge protrusions 7A are set in a counter groove formed on the side surface of the piston, thus achieving a fixing via interlocking forms.

Inside the lower portion of frame 3 is also located a cup 8 for a liquid, such as paint, which cup is located inside of a support piece 9. The cup 8 and the support piece 9 are in this embodiment in form of hollow cylindrical pieces having open upper surfaces and bottom surfaces. When cup 8 is set in the support piece 9, the outer side surfaces of the cup set against the inner side surfaces of the support piece and the outer bottom surface of the cup sets against the bottom inner surface of the support piece. In the center area of the bottom on the cup 8 there is formed an injection opening with protrusion extending outwards from the bottom surface of the cup, through which hole the liquid in the cup is pressed inside the aerosol container 2. Corresponding opening is also formed in the bottom of the support piece 9.

The frame 3 of the filling device 1 is preferably also equipped with supports 17, which support the bottom surface of the support piece 9. With these supports 17 the force created by the downwards movement of the piston 4 is conveyed to the frame 3 of the filling device 1 and not to the structure of the aerosol container 2. The aerosol container 2 is supported via its lower portion so that it remains in contact with the cup 8 and the support piece 9 during the transferring of the liquid from the cup to the aerosol container.

At the bottom outer surface of the support piece 9 there is suitable means for connecting the support piece to the aerosol container 2 in such a way that the protrusion with the injection opening in the bottom of the cup 8 comes into contact with the valve of the aerosol container.

When the filling device 1 is used, the cup 8 is set in the support piece 9, the support piece is connected to the upper end of the aerosol container 2 at the area of the valve of the aerosol container, and the liquid to be transferred into the aerosol container is measured and added in the cup. These actions can be done in any suitable order.

Then the entity comprising the aerosol container 2, support piece 9, cup 8 and the liquid is placed and supported inside the lower portion of the frame 3. After this placement the opening through which the mentioned entity is placed inside the filling device 1 is closed and the transferring process can be started by activating the device 5 for moving the piston 4 downwards and thus pushing the liquid from the cup 8 inside the aerosol container 2 via the injection opening. The downwards movement of the piston 4 is continued until the outer surface of the piston head 7 is substantially in contact with the bottom inner surface of the cup 8 thus making sure that substantially all of the liquid is transferred from the cup to the aerosol container 2.

The piston head 7 is formed and dimensioned such, that the side edge of the piston head sets itself tightly against the inner side surface of the cup 8 thus scraping substantially all the liquid with it from the side surface of the cup. This also helps to maintain the required pressure in the liquid for injecting it through the injection opening of the cup 8 and inside the aerosol container 2.

Once the transfer operation is done, the piston 4 together with the piston head 7 is withdrawn from inside the cup 8 with the device 5, the opening allowing access to the lower portion of frame 3 is opened, and the entity comprising the aerosol can 2, the support piece 9 and the cup 8 is removed from the filling device 1. After the support piece 9 together with the cup 8 is detached from the filled aerosol container 2, the filled aerosol container is ready for packaging.

If a new aerosol container is filled with the same liquid, the above described process is repeated by only attaching a new aerosol container 2 to the support piece 9 and adding a new amount of liquid in cup 8.

If a different liquid, such as different color of paint for example, the piston head 7 and the cup 8 needs to be changed before starting the new filling process with a new aerosol container 2, so that contamination of the new liquid can be avoided. The changing of the piston head 7 is advantageously done in a following way in this embodiment. After the end of the last filling process the raising of the piston 4 is continued until the upper edge of the piston head 7 sets against the lower surface of the support section 6, and then the piston is raised more so that the lower surface of the support section forces the piston head 7 to deform and detach from the piston. For this detachment process of the piston head 7, a separate vessel for the detached piston head 7 is preferably inserted at the place of the filled aerosol container 2 after its removal together with the cup 8 and the support piece 9 from the filling device 1, to which vessel the detached piston head 7 drops after it is detached from the piston 4. Before a new filling process is started a new piston head 7 is attached to the piston.

Because the use of the filling device 1 without the piston head 7 in its place on the piston 4 would lead to significant cleaning operation of the filling device, the filling device advantageously comprises a suitable means (not shown in figures) for detecting that the piston head 7 is attached to the piston 4. These detecting means also advantageously comprise or are connected to means for preventing the activation of the filling device 1 without the piston head 7 at its place. These sensing means can be implemented with a suitable prior art sensing device attached to any rigid section of the filling device 1, that detects the presence of the attached piston head, such as a microswitch for example.

Figure 2A:
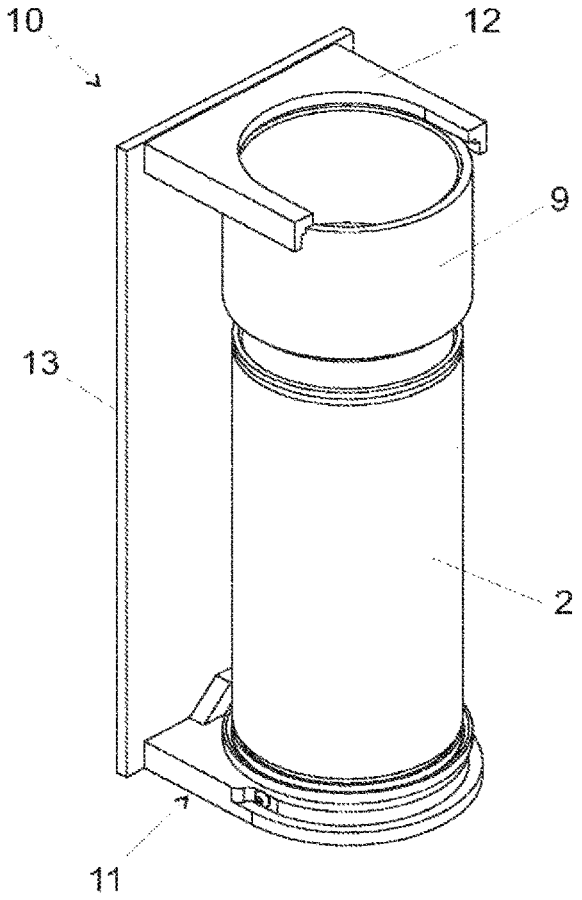
FIGS. 2A-2C show schematically an embodiment for a door construction for the filling device of FIG. 1.
Figure 2B:
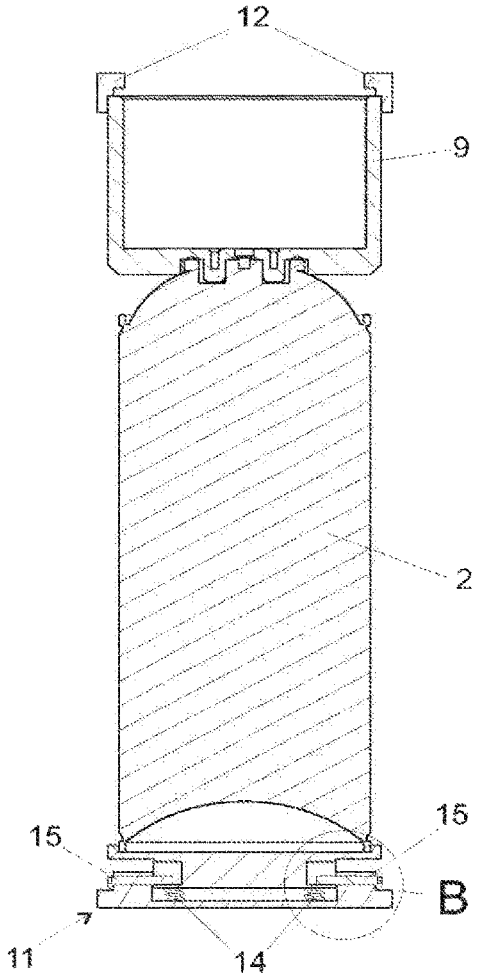
Figure 2C:
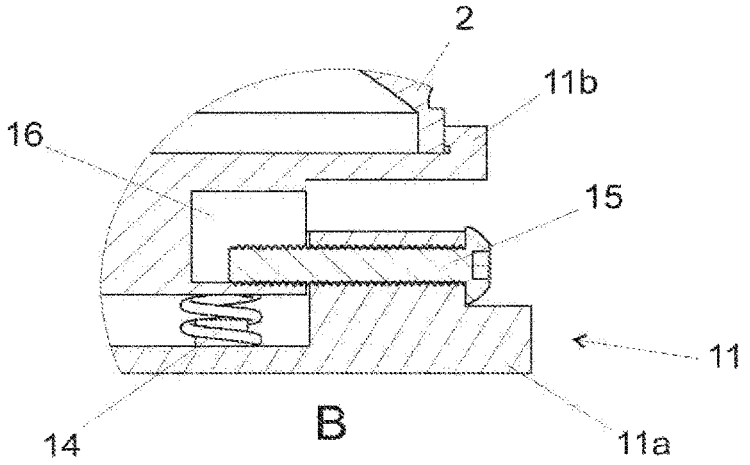

FIGS. 2A-2C show schematically an embodiment of a door construction 10 for the filling device 1 of FIG. 1. FIG. 2A shows the door construction 10 with the aerosol container 2 and support piece 9 as a perspective view, FIG. 2B shows a cross-sectional view of FIG. 2A, and FIG. 2C shows an enlargement of the area B of FIG. 2B.

The door construction 10 shown in FIGS. 2A-2C comprises a door plate 13, a lower support portion 11 and upper support 12. The lower support portion 11 extends from the lower end area of the inner side surface of the door plate 13, and the upper support 12 extends from the upper end area of the inner side surface of the door plate.

When the door construction 10 is placed at its place in the filling machine 1, the door plate 13 covers whole of the area of the closable opening formed in the lower portion of the frame 3 of the filling device 1. The outer side surface of the door construction 10 also preferably forms one side wall of the lower portion of the filling device 1, whereby the filling device has preferably square cross-section perpendicularly in relation to its vertical longitudinal axis. Further, the door construction is preferably an entity that can be completely removed from the rest of the filling device 1, so that inserting and removing of the aerosol canister 2, cup 8 and support piece 9, and the filling of the cup 8 with the liquid, may be done without hindrance from the rest of the structure of the filling machine 1.

The lower support portion 11 of the door construction 10 is formed to support the bottom of the aerosol container 2 to be filled, and the upper support 12 is formed to support the upper side surface and top surface of the support piece 9.

Since the outer dimensions of the aerosol containers 2 to be filled with the filling device 1 can vary, the lower support portion 11 is formed of two parts 11*a* and 11*b*, wherein the vertical distance of the upper part 11*b* from the lower part 11*a* is adjustable accordingly. This adjustability is achieved with a spring-loaded connection between the parts 11*a* and 11*b*. The spring-loaded connection between the lower part 11*a* and the upper part 11*b* is formed in this embodiment with four springs 14, which are arranged between the parts 11*a* and 11*b*, and with two horizontally extending screws 15. The screws 15 are screwed in vertically extending threaded holes in the lower part 11*a* so that their end portion set in openings 16 formed in the upper part 11*b*. The openings 16 are dimensioned so, that their vertical dimension defines the maximum vertical adjustability between the lower part 11*a* and the upper part 11*b*. In an unloaded situation the lower inner surfaces of the openings 16 set against the ends of the screws 15 to keep the parts 11*a* and 11*b* sufficiently supportingly fixed to each other.

When the aerosol container 2 together with the support piece 9 fixed at its upper end is inserted to the door construction 10, the upper part 11*b* of the lower support portion 11 is pressed downwards so that the bottom of the aerosol container 2 can be set on a depression formed in upper surface of the upper part 11*b* and simultaneously the upper side surface and top surface of the support piece 9 are set against the corresponding support surfaces of the upper support 12 of the door construction 10. Once the aerosol container 2 together with the support piece 9 are properly positioned, the upper part 11*b* is released and the spring force from the springs 14 keeps the aerosol container and the support piece at their place in relation to the door construction 10. Now the door construction 10 together with the aerosol container 2 and the support piece 9 form an entity that can be handled together, which helps the insertion of the aerosol container and the support piece together with the cup 8 filled with the liquid into the filling device 1. This insertion is preferably done by purely horizontal movement of this entity in relation to the rest of the filling machine 1.

The upper support 12 of the door construction is formed so, that the support surfaces define proper positioning of the support piece 9 in relation to the upper support, and so that the upper support 12 allows for insertion of the cup 8 with the liquid in the support piece 9 when it is set at its place in the door construction 10.

The door construction 10 may also comprise suitable supports (not shown), such as supports 17 shown in FIG. 1, for supporting the bottom surface of the support piece 9. These supports may be formed to the frame 3 of the filling device 1 as the supports 17 shown in FIG. 1, to the door construction 10, or to both.

The upper part 11*b* of the lower support portion 11 of the door construction is preferably also equipped with one or more magnets (not shown) than enhance the fixing of the aerosol container 2, which are typically of suitable metallic material, to the lower support portion 11 of the door construction 10. Further, these magnet(s) also help to keep a collection vessel at its place for receiving the detached piston head 7 when the piston head need to be changed, for example.

The above discussed door construction 10 allows for improved preparation and implementing of the filling process with a filling device 1, where the possibility for spilling of the liquid to be transferred before and during of the filling process is advantageously minimized.

The specific exemplifying embodiment of the invention shown in figures and discussed above should not be construed as limiting. A person skilled in the art can amend and modify the embodiment of the invention described in many evident ways within the scope of the attached claims. Thus, the invention is not limited merely to the embodiment described above.

The invention claimed is:

1. A filling device for filling an aerosol container with a liquid, such as paint, the device comprising:

a cup for the liquid for the aerosol container, which cup is provided with an injection opening at its bottom surface, a piston for pushing the liquid from the cup via the injection opening to the aerosol container, and a piston head that is adapted to be detachably fixed on an outer edge of the piston via one or more edge protrusions of the piston head to be in contact with the liquid in the cup when the liquid is transferred from the cup to the aerosol container, which piston head is in the form of a scraper in continuous contact with the side wall of the cup during the liquid transferring operation, wherein the detachable fixing of the piston head allows the piston head to be withdrawn together with the piston from the cup after the liquid transferring operation is done.

2. The filling device according to claim 1, wherein the detachable fixing of the piston head to the piston is implemented with interlocking forms.

3. The filling device according to claim 1, wherein the device comprises means for detaching the piston head from the piston.

4. The filling device according to claim 1, wherein the device comprises devices for detecting the attachment of the piston head to the piston.

5. The filling device according to claim 4, wherein the device comprises means for preventing the activation or use of the device when the attachment of the piston head to the piston is not detected.

6. The filling device according to claim 1, wherein the filling device comprises a door construction for inserting the aerosol container into the device and removing the aerosol container from the device, which door construction comprises support for the aerosol container.

7. The filling device according to claim 6, wherein the door construction comprises support for the cup for the liquid or for a part supporting the cup.

8. The filling device according to claim 6, wherein the support for the aerosol container in the door construction supports the aerosol container from the lower end area of the container, and that the support for the aerosol container comprises mechanism for adjusting the vertical position of the support surface.

9. The filling device according to claim 6, wherein the door construction is formed as a detachable entity from the rest of the filling device, to which entity the aerosol container and the cup for the liquid is attachable prior to inserting the door construction into the filling device.

10. The filling device according to claim 6, wherein the support for the aerosol container in the door construction comprises at least one magnet.

* * * * *